US012066212B2

(12) United States Patent
Dean

(10) Patent No.: US 12,066,212 B2
(45) Date of Patent: Aug. 20, 2024

(54) SYSTEMS AND METHODS FOR A REFRIGERANT SUB-SYSTEM FOR A HEATING, VENTILATION, AND AIR CONDITIONING SYSTEM

(71) Applicant: Copeland LP, Sidney, OH (US)

(72) Inventor: William J. Dean, Greenville, IL (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 18/145,130

(22) Filed: Dec. 22, 2022

(65) Prior Publication Data

US 2023/0128439 A1 Apr. 27, 2023

Related U.S. Application Data

(63) Continuation of application No. 17/033,409, filed on Sep. 25, 2020, now abandoned.

(51) Int. Cl.
*F24F 3/14* (2006.01)
*F24F 5/00* (2006.01)

(52) U.S. Cl.
CPC ..... *F24F 3/1405* (2013.01); *F24F 5/0003* (2013.01); *F24F 5/001* (2013.01); *F24F 2003/1446* (2013.01); *F24F 2203/021* (2013.01)

(58) Field of Classification Search
CPC ..... F24F 3/1405; F24F 5/0003; F24F 5/001; F24F 2003/1446; F24F 2203/021
See application file for complete search history.

(56) References Cited

U.S. PATENT DOCUMENTS 4,373,347 A * 2/1983 Howell ..... F25B 15/06 62/235.1
4,653,287 A * 3/1987 Martin, Jr. ..... F25B 29/003 62/235.1

(Continued)

FOREIGN PATENT DOCUMENTS

DE 102006024796 A1 9/2007
EP 2966386 A1 * 1/2016 ..... F25B 13/00

(Continued)

OTHER PUBLICATIONS

International Search Report and Written Opinion issued in PCT/US2021/051260 mailed Jan. 7, 2022; pp. 1-13.

*Primary Examiner* — David J Teitelbaum
(74) *Attorney, Agent, or Firm* — Armstrong Teasdale LLP

(57) ABSTRACT

A heating, ventilation, and air conditioning (HVAC) system includes a hot water sub-system including a first heat exchanger and a condenser, a cold water sub-system including a second heat exchanger and an evaporator, and a refrigerant sub-system for transferring heat from the cold water sub-system to the hot water sub-system. The first and second heat exchangers transfer moisture and heat between a liquid desiccant and air. The refrigerant sub-system includes a compressor, the condenser, an expansion valve, the evaporator, and a refrigerant-air heat exchanger. The condenser transfers heat from compressed refrigerant to the hot water sub-system. The evaporator transfers heat from the cold water sub-system to uncompressed refrigerant. The refrigerant-air heat exchanger transfers heat from a portion of the compressed refrigerant to air in a first operating mode, and transfers heat from the air to a portion of the uncompressed refrigerant in a second operating mode.

20 Claims, 7 Drawing Sheets

(56) References Cited

U.S. PATENT DOCUMENTS

| | | | | |
|---|---|---|---|---|
| 5,005,371 | A * | 4/1991 | Yonezawa | F25B 17/08 62/480 |
| 8,800,308 | B2 | 8/2014 | Vandermuelen | |
| 8,943,850 | B2 | 2/2015 | Vandermuelen | |
| 9,000,289 | B2 | 4/2015 | Vandermuelen | |
| 9,243,810 | B2 | 1/2016 | Vandermuelen | |
| 9,273,877 | B2 | 3/2016 | Vandermuelen | |
| 9,308,490 | B2 | 4/2016 | Vandermuelen | |
| 9,377,207 | B2 | 6/2016 | Vandermuelen | |
| 9,429,332 | B2 | 8/2016 | Vandermuelen | |
| 9,470,426 | B2 | 10/2016 | Vandermuelen | |
| 9,631,823 | B2 | 4/2017 | Vandermuelen | |
| 9,631,848 | B2 | 4/2017 | Vandermuelen | |
| 9,709,285 | B2 | 7/2017 | Vandermuelen | |
| 10,024,558 | B2 | 7/2018 | Vandermuelen | |
| 10,024,601 | B2 | 7/2018 | Vandermuelen | |
| 10,041,708 | B2 * | 8/2018 | Sedlak | H05K 7/20 |
| 2006/0201188 | A1 * | 9/2006 | Kopko | F25B 9/008 62/333 |

FOREIGN PATENT DOCUMENTS

| | | | |
|---|---|---|---|
| EP | 2966386 | A1 | 1/2016 |
| FR | 2886388 | A1 | 12/2006 |

* cited by examiner

SYSTEMS AND METHODS FOR A REFRIGERANT SUB-SYSTEM FOR A HEATING, VENTILATION, AND AIR CONDITIONING SYSTEM

CROSS-REFERENCE TO RELATED APPLICATIONS

This application is a continuation application of and claims priority to U.S. patent application Ser. No. 17/033,409, filed Sep. 25, 2020, the disclosure of which is hereby incorporated herein by reference in its entirety.

FIELD

The field relates generally to heating, ventilation, and air conditioning systems, and more particularly, to systems and methods for a refrigerant sub-system of a heating, ventilation, and air conditioning system.

BACKGROUND

Heating, ventilation, and air conditioning (HVAC) systems may include multiple sub-systems that improve the heating, cooling, and moisture removal capabilities of the HVAC system. For example, HVAC systems may include a refrigerant sub-system, a hot water sub-system, and a cold water sub-system, which improve the efficiency of the HVAC system. The hot and cold water sub-systems may each include heat transfer equipment that is used intermittently to reject or absorb heat to and from the atmosphere as determined by operational conditions of the HVAC system. Specifically, the hot water sub-system may include an air cooler for rejecting heat to the atmosphere, and the cold water sub-system may include an air-to-water heat exchanger for absorbing heat from the atmosphere. The air cooler of the hot water sub-system is used to reject excess heat when additional cooling is required, and the air to water heat exchanger of the cold water sub-system is used to absorb heat when excess cooling occurs. However, the air cooler of the hot water sub-system and the air to water heat exchanger of the cold water sub-system are not used simultaneously. Having idle heat transfer equipment adds to the operational complexity of the system and increases the capital cost of the HVAC system.

This background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a refrigerant sub-system for a heating, ventilation, and air conditioning system includes a compressor, a condenser, an expansion valve, an evaporator, and a refrigerant-air heat exchanger. The compressor receives uncompressed, vapor refrigerant at a first pressure, and the refrigerant exits the compressor as a compressed, vapor refrigerant at a second pressure higher than the first pressure. The condenser condenses the compressed, vapor refrigerant into a compressed, liquid refrigerant and transfers heat from the compressed, vapor refrigerant to a first fluid. The expansion valve expands the compressed, liquid refrigerant into an uncompressed, liquid refrigerant. The evaporator vaporizes the uncompressed, liquid refrigerant into the uncompressed, vapor refrigerant at the first pressure and transferring heat from a second fluid to the uncompressed, vapor refrigerant. The refrigerant-air heat exchanger has a first operating mode and a second operating mode. In the first operating mode, the condenser is adapted to condense a first portion of the compressed, vapor refrigerant from a vapor to a liquid, and the refrigerant-air heat exchanger is adapted to condense a second portion of the compressed, vapor refrigerant from a vapor to a liquid and transfer heat from the second portion of the compressed, vapor refrigerant to air.

In another aspect, a heating, ventilation, and air conditioning system includes a hot water sub-system for circulating a flow of a first fluid, a cold water sub-system for circulating a flow of a second fluid, and a refrigerant sub-system for transferring heat from the cold water sub-system to the hot water sub-system and the environment. The refrigerant sub-system includes a compressor, a condenser, an expansion valve, an evaporator, and a refrigerant-air heat exchanger. The compressor receives uncompressed, vapor refrigerant at a first pressure, and the refrigerant exits the compressor as a compressed, vapor refrigerant at a second pressure higher than the first pressure. The condenser condenses the compressed, vapor refrigerant into a compressed, liquid refrigerant and transfers heat from the compressed, vapor refrigerant to a first fluid. The expansion valve expands the compressed, liquid refrigerant into an uncompressed, liquid refrigerant. The evaporator vaporizes the uncompressed, liquid refrigerant into the uncompressed, vapor refrigerant at the first pressure and transferring heat from a second fluid to the uncompressed, vapor refrigerant. The refrigerant-air heat exchanger has a first operating mode and a second operating mode. In the first operating mode, the condenser is adapted to condense a first portion of the compressed, vapor refrigerant from a vapor to a liquid, and the refrigerant-air heat exchanger is adapted to condense a second portion of the compressed, vapor refrigerant from a vapor to a liquid and transfer heat from the second portion of the compressed, vapor refrigerant to air.

In yet another aspect, a method of transferring heat from a cold water sub-system of a heating, ventilation, and air conditioning (HVAC) system to a hot water sub-system of the HVAC system using a refrigerant sub-system includes compressing an uncompressed, vapor refrigerant at a first pressure into a compressed, vapor refrigerant at a second pressure higher than the first pressure using a compressor. The refrigerant sub-system includes the compressor, a condenser, an evaporator, an expansion valve, and a refrigerant-air heat exchanger. The method also includes condensing the compressed, vapor refrigerant into a compressed, liquid refrigerant and transferring heat from the compressed, vapor refrigerant to a first fluid using the condenser. The method further includes expanding the compressed, liquid refrigerant into an uncompressed, liquid refrigerant using the expansion valve. The method also includes vaporizing the uncompressed, liquid refrigerant into the uncompressed, vapor refrigerant at the first pressure and transferring heat from a second fluid to the uncompressed, vapor refrigerant using the evaporator. The method further includes condensing, in a first operating mode, a first portion of the compressed, vapor refrigerant from a vapor to a liquid using the condenser, and condensing a second portion of the compressed, vapor refrigerant from a vapor to a liquid and transferring heat from the second portion of the compressed, vapor refrigerant to air using the refrigerant-air heat exchanger.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the drawings.

DETAILED DESCRIPTION

Figure 1:
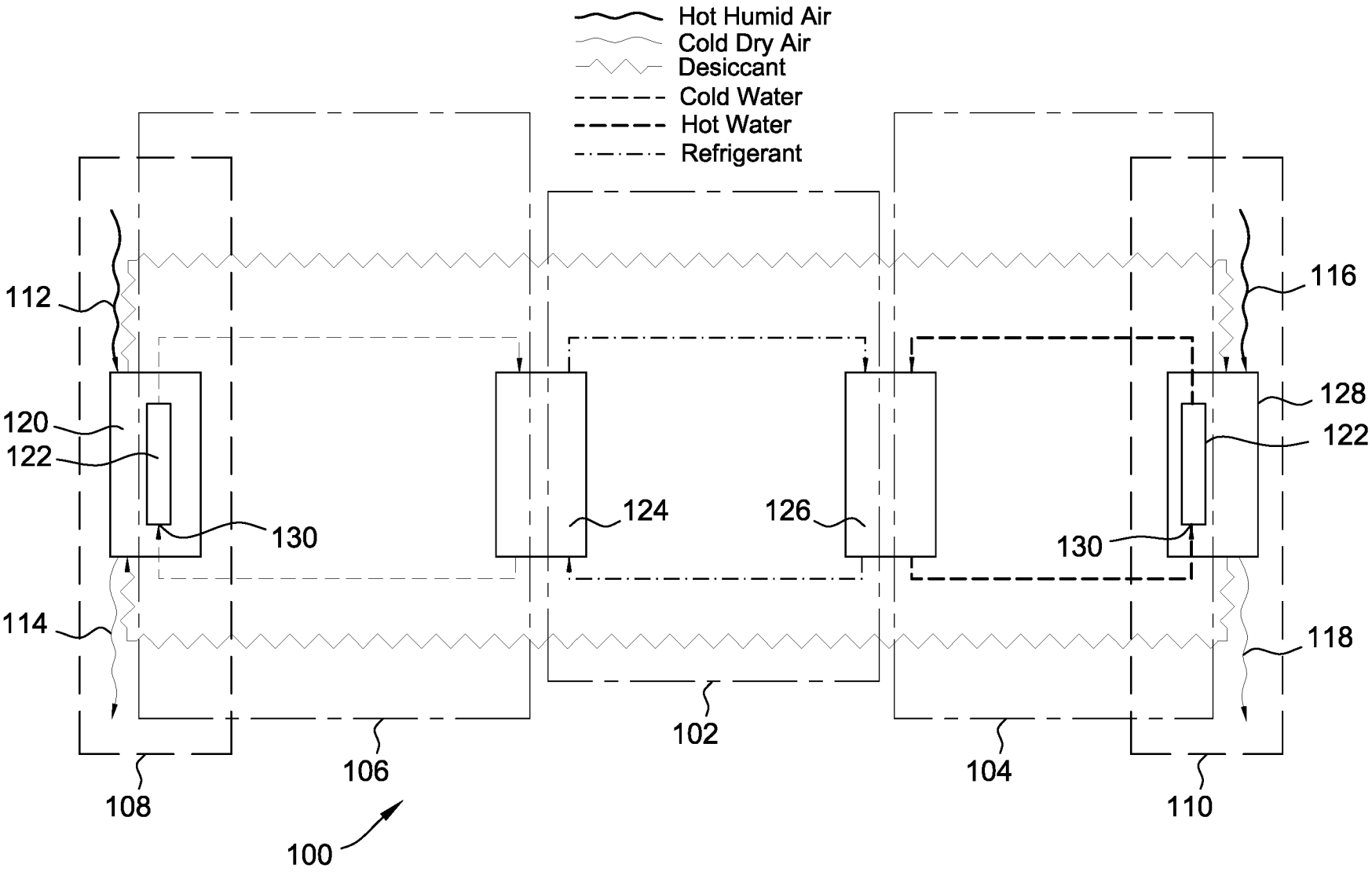
FIG. 1 is a schematic flow diagram of a heating, ventilation, and air conditioning (HVAC) system.

FIG. 1 is a schematic flow diagram of a heating, ventilation, and air conditioning (HVAC) system 100. While the HVAC system 100 may be any type of HVAC system, the HVAC system 100 is more efficient than prior HVAC systems because the HVAC system 100 includes sub-systems 102-110 which improve the heating, cooling, and moisture removal capabilities of system 100 when compared to prior systems. Specifically, the HVAC system 100 includes a refrigerant sub-system 102, two water sub-systems 104 and 106, a conditioning sub-system 108, and a regeneration sub-system 110. The water sub-systems 104 and 106 include a hot water sub-system 104 and a cold water sub-system 106. The conditioning sub-system 108 removes heat and moisture from a flow of conditioning inlet air 112 and channels a flow of conditioning outlet air 114 to a structure or vehicle (not shown). The conditioning outlet air 114 has a lower temperature and humidity than the conditioning inlet air 112 because the conditioning sub-system 108 has removed heat and moisture from the air. The sub-systems 102-110 transfer the heat and moisture from the conditioning sub-system 108 to the regeneration sub-system 110. The regeneration sub-system 110 transfers the heat and moisture into a flow of regeneration inlet air 116 and channels a flow of regeneration outlet air 118 to the atmosphere.

The conditioning sub-system 108 cools the conditioning inlet air 112 with latent and sensible cooling of the conditioning inlet air. Sensible cooling reduces the temperature of the conditioning inlet air 112 by removing heat from the conditioning inlet air. Latent cooling reduces the temperature of the conditioning inlet air 112 by removing moisture from the conditioning inlet air. As described below, the conditioning sub-system 108 includes a 3-way heat exchanger that transfers heat and moisture from the conditioning inlet air 112, simultaneously cooling the conditioning inlet air with latent and sensible cooling. Additionally, the cold water sub-system 106 controls the sensible cooling, and the hot water sub-system 104 controls the latent cooling. The refrigerant sub-system 102 described herein shifts cooling between the cold water sub-system 106 and the hot water sub-system 104 depending on the outside conditions. More specifically, the HVAC system 100 may be required to supply a specific ratio of sensible cooling to latent cooling to achieve specific temperature and humidity set points for conditioning outlet air 114. The refrigerant sub-system 102 shifts cooling between the cold water sub-system 106 and the hot water sub-system 104 to tune the sensible and latent cooling of the conditioning inlet air 112 to achieve specific temperature and humidity set points for conditioning outlet air 114.

The conditioning sub-system 108 shares a first heat exchanger 120 with the cold water sub-system 106 and the regeneration sub-system 110 and interfaces with the cold water sub-system and the regeneration sub-system through the first heat exchanger. In this embodiment, the first heat exchanger 120 is a 3-way heat exchanger that transfers heat from the conditioning inlet air 112 to a first fluid and a transfers heat and moisture from the conditioning inlet air 112 to a second fluid. The first heat exchanger 120 includes a membrane (not shown) that permits both heat and moisture to be transferred from the conditioning inlet air 112 to the second fluid and a membrane 122 that channels the first fluid through the first heat exchanger 120 and transfers heat from the conditioning inlet air 112 and the second fluid to the first fluid. In this embodiment, the first fluid is a flow of water circulated by the cold water sub-system 106, and the second fluid is a flow of a liquid desiccant circulated by the conditioning sub-system 108 and the regeneration sub-system 110. In alternative embodiments, the first fluid may be any fluid that enables the conditioning sub-system 108 and the cold water sub-system 106 to operate as described herein, and the second fluid may be any fluid that enables the conditioning sub-system 108 and the regeneration sub-system 110 to operate as described herein, including, but not limited, to any type of desiccant. For example, the second fluid may be a solid desiccant in a slurry.

The cold water sub-system 106 shares the first heat exchanger 120 with the conditioning sub-system 108 and shares an evaporator 124 with the refrigerant sub-system 102. As described below, the cold water sub-system 106 transfers heat from the first heat exchanger 120 to the evaporator 124 or to the atmosphere. More specifically, the cold water sub-system 106 may include additional heat transfer equipment that transfers heat to the atmosphere. The remainder of the heat is transferred to the refrigerant sub-system 102 through the evaporator 124. Additionally, in the illustrated embodiment, the cold water sub-system 106 is a closed, non-pressurized system that does not permit material from the surrounding environment to enter the sub-system, preventing contaminates from entering the sub-system and contaminating the sub-system. In alternative embodiments, the cold water sub-system 106 may be an open, non-pressurized system. As used herein, non-pressurized means that the sub-system operates at 5 pounds per square inch gauge pressure (psig) or less.

The refrigerant sub-system 102 shares the evaporator 124 with the cold water sub-system 106 and shares a condenser 126 with the hot water sub-system 104. As described below, the refrigerant sub-system 102 transfers heat from the evaporator 124 to the condenser 126, and the condenser 126 transfers heat to the hot water sub-system 104. Specifically, the refrigerant sub-system 102 channels a refrigerant from the evaporator 124 to the condenser 126, and the refrigerant transfers the heat from the evaporator 124 to the condenser 126.

The hot water sub-system 104 shares a second heat exchanger 128 with the regeneration sub-system 110 and shares the condenser 126 with the refrigerant sub-system 102. As described below, the hot water sub-system 104 transfers heat from the condenser 126 to the second heat exchanger 128 or to the atmosphere. More specifically, the hot water sub-system 104 may include additional heat transfer equipment that transfers heat to the atmosphere. The remainder of the heat is transferred to regeneration sub-system 110 through the second heat exchanger 128. Additionally, in the illustrated embodiment, the hot water sub-system 104 is a closed, non-pressurized system that does not permit material from the surrounding environment to enter the sub-system, preventing contaminates from entering the sub-system and contaminating the sub-system. In alternative embodiments, the hot water sub-system 104 may be an open, non-pressurized system. As used herein, non-pressurized means that the sub-system operates at 5 psig or less.

The regeneration sub-system 110 shares the second heat exchanger 128 with the hot water sub-system 104 and the conditioning sub-system 108 and interfaces with the hot water sub-system and the conditioning sub-system through the second heat exchanger. In this embodiment, the second heat exchanger 128 is a 3-way heat exchanger that transfers heat from a first fluid to the regeneration inlet air 116 and a transfers heat and moisture from a second fluid to the regeneration inlet air 116. The second heat exchanger 128 includes a membrane (not shown) that permits both heat and moisture to be transferred from the second fluid to the regeneration inlet air 116 and a membrane 122 that channels the first fluid through the second heat exchanger 128 and transfers heat from the first fluid to the regeneration inlet air 116 and the second fluid. In the illustrated embodiment, the first fluid is a flow of water circulated by the hot water sub-system 104, and the second fluid is a flow of a liquid desiccant circulated by the conditioning sub-system 108 and the regeneration sub-system 110. In alternative embodiments, the first fluid may be any fluid that enables the regeneration sub-system 110 and the hot water sub-system 104 to operate as described herein, and the second fluid may be any fluid that enables the regeneration sub-system 110 and the conditioning sub-system 108 to operate as described herein.

Still with reference to FIG. 1, the first heat exchanger 120 and the second heat exchanger 128 are substantially the same. In alternative embodiments, the first heat exchanger 120 and the second heat exchanger 128 are different. Specifically, in this embodiment, both the first heat exchanger 120 and the second heat exchanger 128 include the membrane 122 for channeling the first fluid through the heat exchangers and for exchanging heat between the first fluid, the second fluid, and a flow of air. In one embodiment, the membrane 122 is a non-rigid, flexible material that permits heat transfer into and out of the first fluid while preventing the first fluid from mixing with any other fluid, including the second fluid and the flow of air. Specifically, the membrane 122 is a non-rigid, flexible material that is designed to be non-pressurized (operate at or below 5 psig) and is not designed to operate at a substantially greater pressure (e.g., 10 psig). More specifically, in this embodiment, the membrane 122 includes a bladder or polymer sack that permits heat transfer into and out of the first fluid while preventing the first fluid from mixing with any other fluid, including the second fluid and the flow of air and operates at or below 5 psig. The membrane 122 is flexible because the material that forms the membrane is capable of bending without breaking and the membrane is non-rigid because the membrane is capable of changing size and shape without breaking. As discussed below, in this embodiment, the membrane 122 is flexible and non-rigid because the membrane is maintained in a collapsed configuration. In alternative embodiments, the membrane 122 is formed of any material and has any degree of flexibility and rigidity that enables the first heat exchanger 120 and the second heat exchanger 128 to operate as described herein.

More specifically, the membrane 122 is filled with the first fluid and is positioned proximate the second fluid and the flow of air within the first and second heat exchangers 120 and 128. In some embodiments, the membrane 122 physically contacts at least one of the second fluid and the flow of air to promote enhanced heat transfer between the first fluid, the second fluid, and the flow of air. For example, the membrane 122 may be immersed in the second fluid and/or the flow of air to promote enhanced heat transfer between the first fluid, the second fluid, and the flow of air. The first heat exchanger 120 and the second heat exchanger 128 are non-pressurized heat exchangers because they include non-pressurized elements (the membrane 122) and portions of the heat exchangers are designed to be non-pressurized (operate at or below 5 psig).

The first heat exchanger 120 cools the conditioning inlet air 112 with latent and sensible cooling by reducing the temperature of the conditioning inlet air and removing moisture from the conditioning inlet air. Specifically, the first heat exchanger 120 sensibly cools the conditioning inlet air 112 exchanging heat between the first fluid and the conditioning inlet air. The first fluid reduces the temperature of the conditioning inlet air 112, and the cold water sub-system 106 controls the temperature of the first fluid. Thus, the cold water sub-system 106 controls the sensible cooling of the conditioning inlet air 112. Additionally, the first heat exchanger 120 cools the conditioning inlet air 112 with latent with latent cooling by removing moisture from the conditioning inlet air. The second fluid removes moisture from the conditioning inlet air 112, and the second heat exchanger 128 removes moisture from the second fluid. The temperature of the first fluid circulated by the hot water sub-system 104 determines the amount of moisture removed from the second fluid, which determines the amount of moisture removed from the conditioning inlet air 112 by the second fluid within the first heat exchanger 120. Thus, the temperature of the first fluid within the cold water sub-system 106 controls the sensible cooling of the conditioning inlet air 112, and the temperature of the first fluid within the hot water sub-system 104 controls the latent cooling of the conditioning inlet air. The refrigerant sub-system 102 described herein shifts cooling between the cold water sub-system 106 and the hot water sub-system 104 to tune the temperature of the first fluid within the hot and cold water sub-systems to tune sensible and latent cooling of the conditioning inlet air 112 to achieve specific temperature and humidity set points for conditioning outlet air 114.

Figure 2:
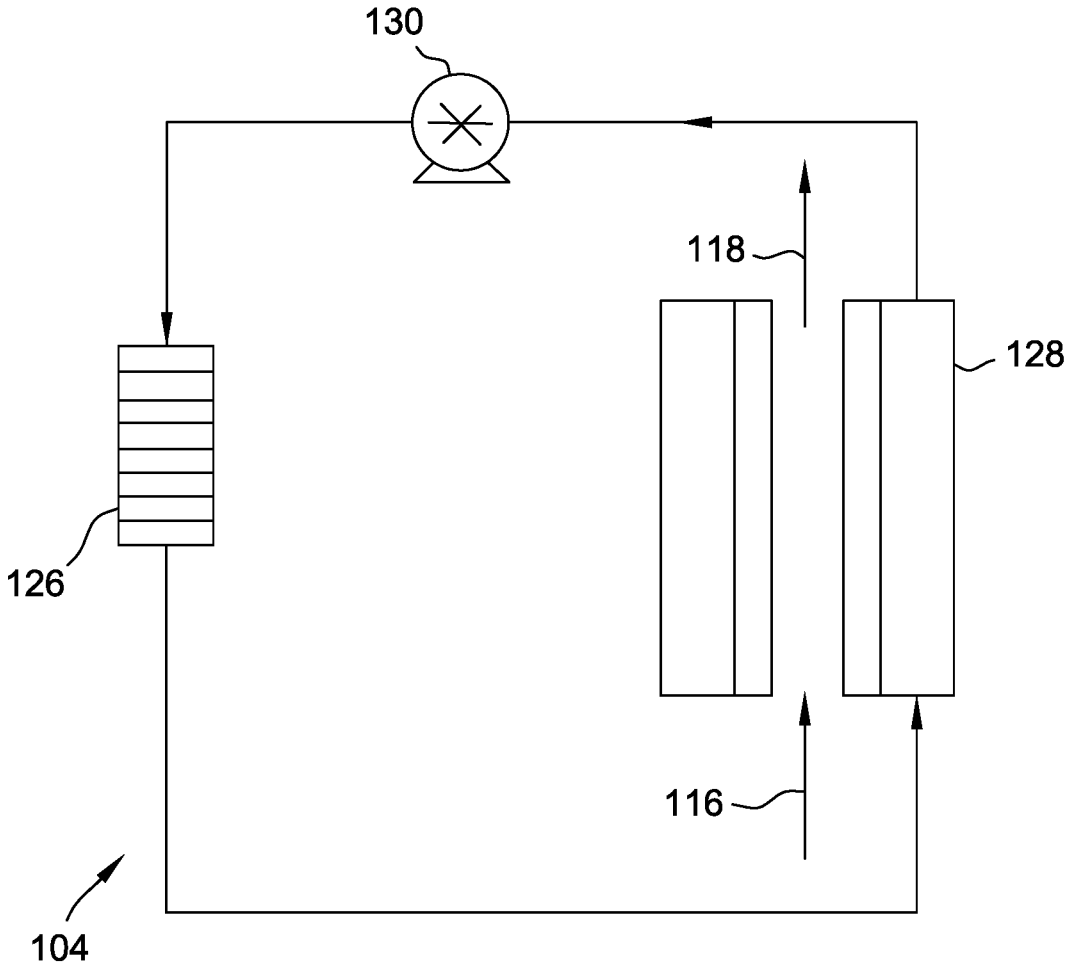
FIG. 2 is a schematic flow diagram of a hot water sub-system illustrated in FIG. 1.

FIG. 2 is a schematic flow diagram of the hot water sub-system 104. The hot water sub-system 104 includes the second heat exchanger 128, the condenser 126, and a first pump 130. In this embodiment, the first pump 130 is a centrifugal pump that receives the first fluid from the second heat exchanger 128 and pumps the first fluid to the condenser 126 and back to the second heat exchanger. However, in alternative embodiments, the pump 130 may be any type of pump that enables the hot water sub-system 104 to operate as described herein. During operation, the first pump 130 pumps the first fluid through the condenser 126 and the second heat exchanger 128. The condenser 126 transfers heat from refrigerant circulated within the refrigerant sub-system 102 to the first fluid. The second heat exchanger 128 transfers heat from the first fluid to the regeneration inlet air 116.

Figure 3:
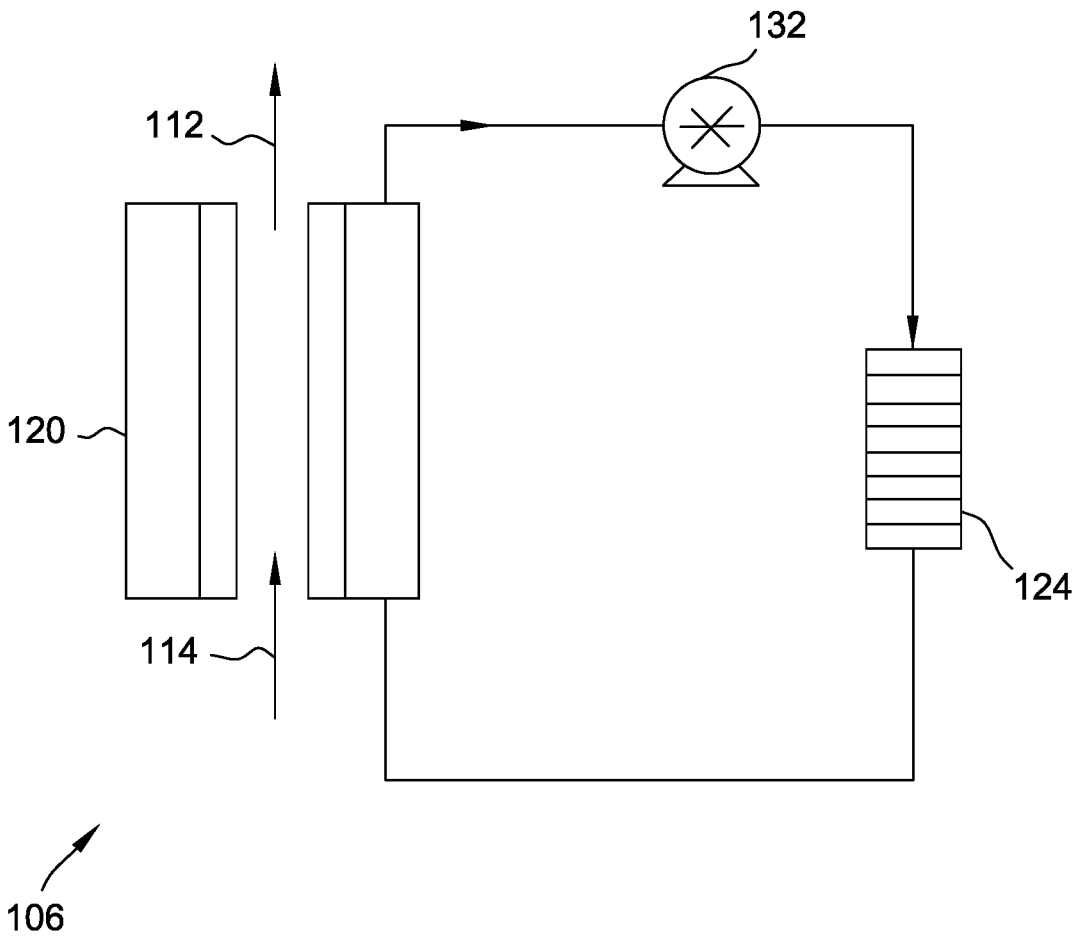
FIG. 3 is a schematic flow diagram of a cold water sub-system illustrated in FIG. 1.

FIG. 3 is a schematic flow diagram of the cold water sub-system 106.

The cold water sub-system 106 includes the first heat exchanger 120, the evaporator 124, and a second pump 132. In this embodiment, the second pump 132 is a centrifugal pump that receives the first fluid from the first heat exchanger 120 and pumps the first fluid to the evaporator 124 and back to the first heat exchanger. However, in alternative embodiments, the pump 132 may be any type of pump that enables the hot water sub-system 104 to operate as described herein. During operation, the second pump 132 pumps the first fluid through the evaporator 124 and the first heat exchanger 120. The evaporator 124 transfers heat from the first fluid to refrigerant circulated within the refrigerant sub-system 102. The first heat exchanger 120 transfers heat from the conditioning inlet air 112 to the first fluid.

Figure 4:
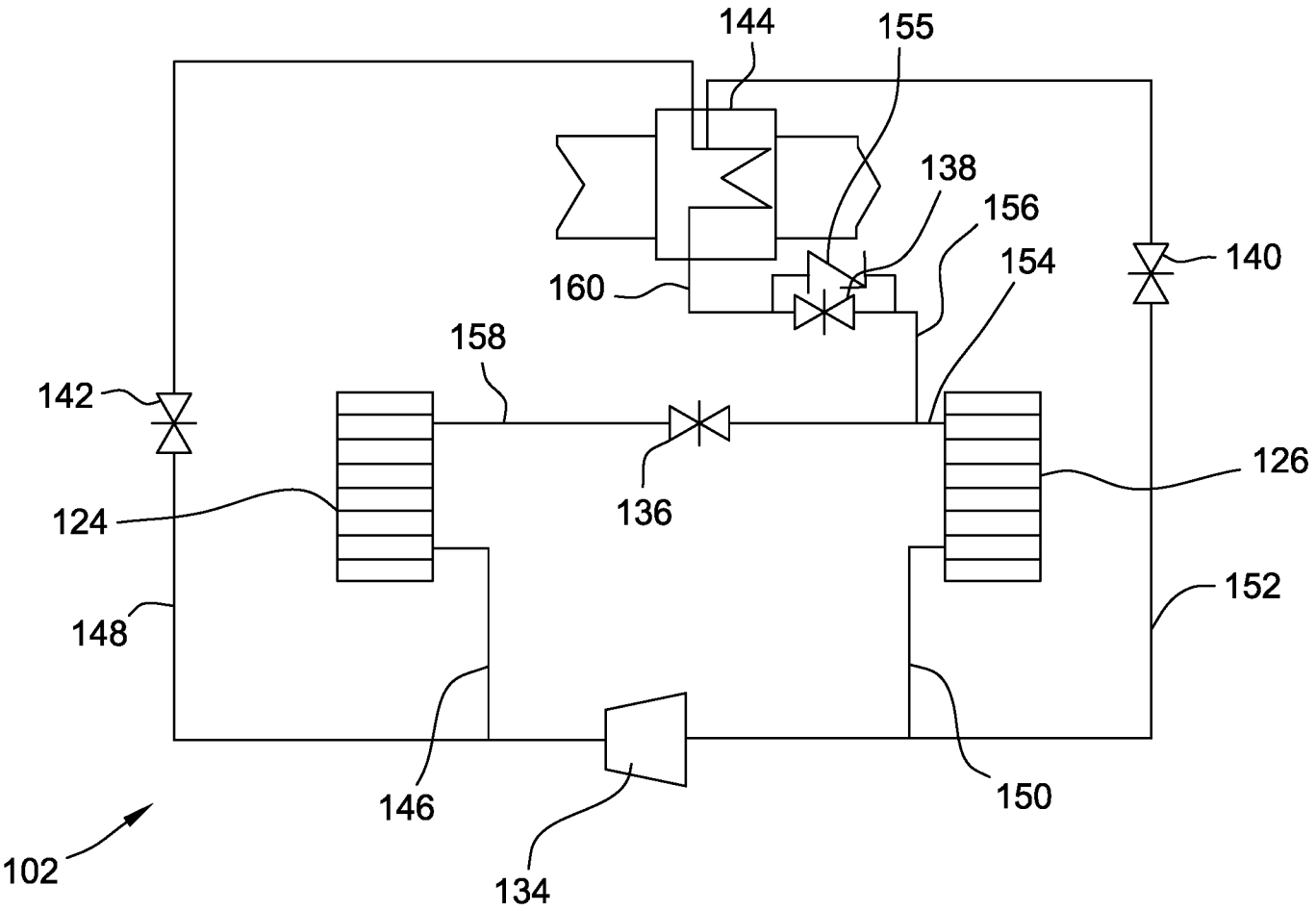
FIG. 4 is a schematic flow diagram of a refrigerant sub-system illustrated in FIG. 1.

FIG. 4 is a schematic flow diagram of the refrigerant sub-system 102. The refrigerant sub-system 102 includes the evaporator 124, the condenser 126, a compressor 134, a first expansion valve 136, a second expansion valve 138, a first on/off valve 140, a second on/off valve 142, and a refrigerant-air heat exchanger 144. In this embodiment, the compressor 134 is a scroll compressor. In alternative embodiments, the compressor 134 may be any type of compressor that enables the refrigerant sub-system 102 to operate as described herein. In this embodiment, the first and second on/off valves 140 and 142 are solenoid valves, and the first and second expansion valves 136 and 138 are thermal expansion valves. In alternative embodiments, the first and second on/off valves 140 and 142 and the first and second expansion valves 136 and 138 may be any type of valves that enable the refrigerant sub-system 102 to operate as described herein.

Figure 5:
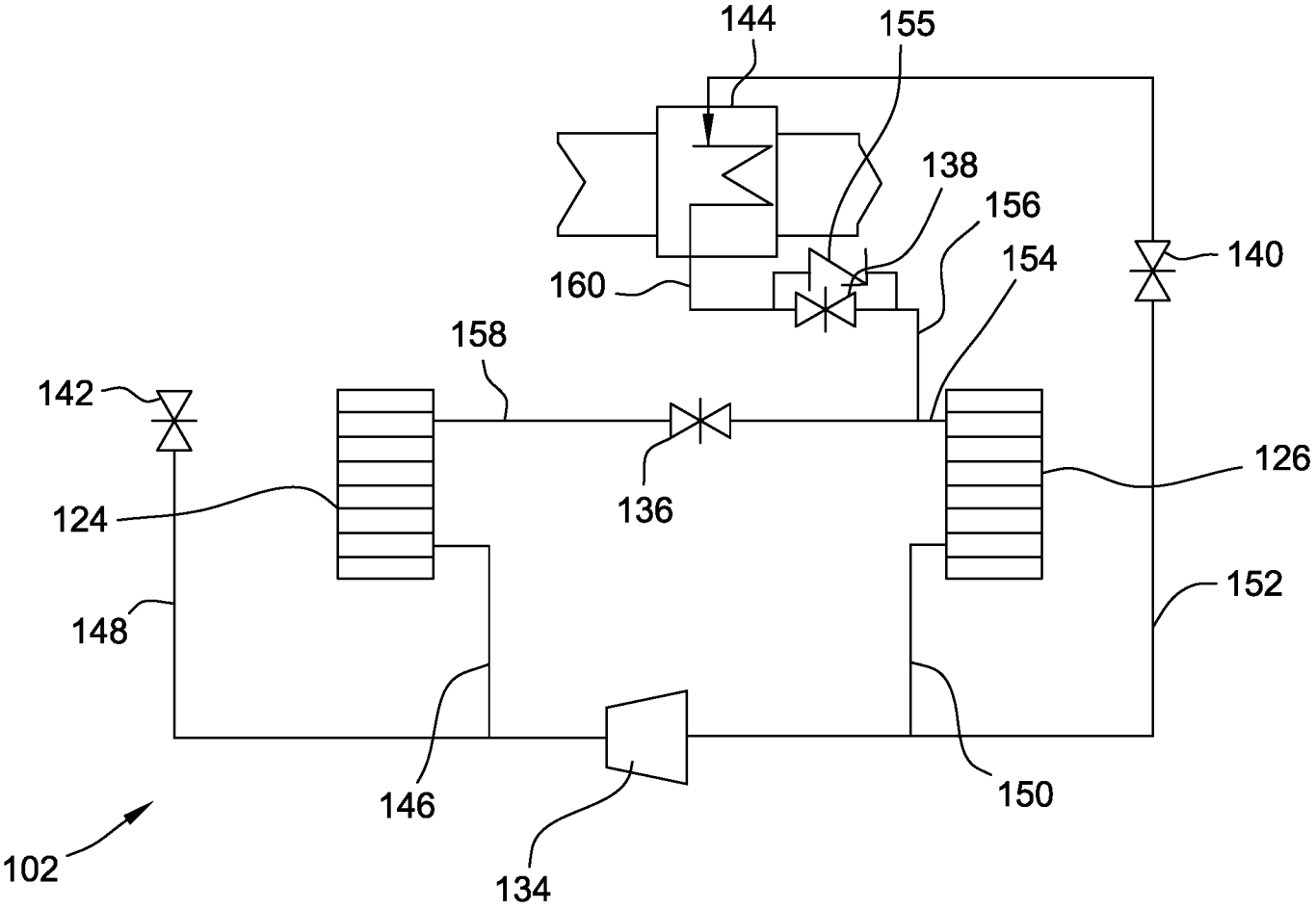
FIG. 5 is a schematic flow diagram of the refrigerant sub-system illustrated in FIG. 4 in a first operating mode.
Figure 6:
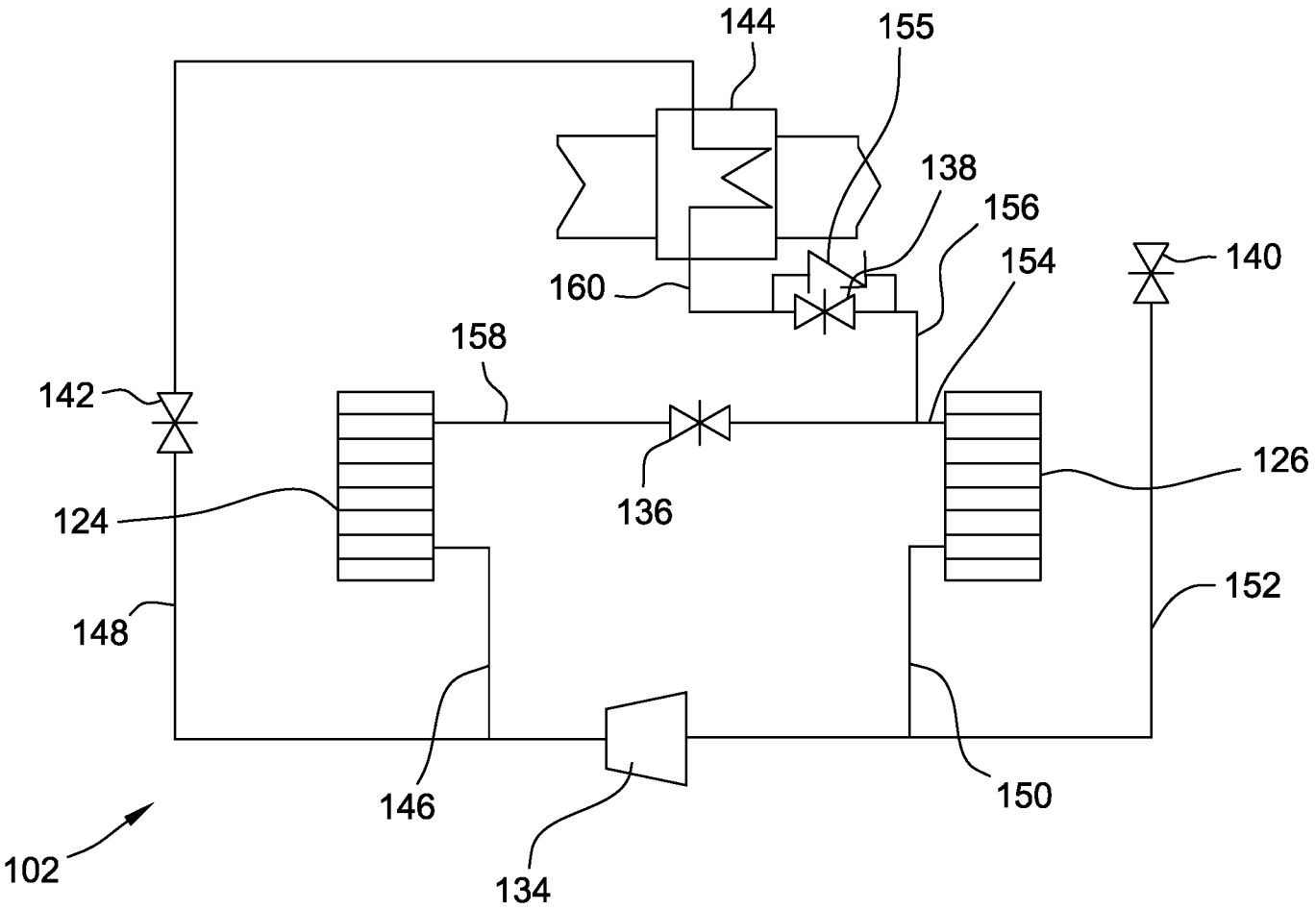
FIG. 6 is a schematic flow diagram of the refrigerant sub-system illustrated in FIG. 4 in a second operating mode.

The refrigerant sub-system 102 has three operating modes: a first operating mode illustrated in FIG. 5, a second operating mode illustrated in FIG. 6, and a third operating mode that is not illustrated. The three operating modes enable the refrigerant sub-system 102 to increase heat transfer into and out of the refrigerant depending on the operational requirements of the HVAC system 100. The operational requirements of the HVAC system 100 are determined by the set points of the system. Specifically, in this embodiment, the operational requirements of the HVAC system 100 are determined by a dry bulb set point of the conditioning outlet air 114 and a dew point set point of the conditioning outlet air 114. In alternative embodiments, other operational parameters may determine the operational requirements of the HVAC system 100. The dry bulb set point and the dew point set point of the conditioning outlet air 114 are typically set by the user.

In this embodiment, the dry bulb temperature of the conditioning outlet air 114 (sensible cooling) is determined by a temperature of the first fluid circulated by the cold water sub-system 106. A colder first fluid transfers more heat away from the conditioning inlet air 112, lowering the dry bulb temperature of the conditioning outlet air 114. Conversely, a warmer first fluid transfers less heat away from the conditioning inlet air 112, increasing the dry bulb temperature of the conditioning outlet air 114. Additionally, in this embodiment, the dew point of the conditioning outlet air 114 (latent cooling) is determined by a temperature of the first fluid circulated by the hot water sub-system 104. A warmer first fluid ultimately transfers more moisture away from the conditioning inlet air 112, lowering the dew point of the conditioning outlet air 114. Conversely, a colder first fluid transfers less moisture away from the conditioning inlet air 112, increasing the dew point of the conditioning outlet air 114.

However, in a typical HVAC system, the temperature of the first fluid in the cold water sub-system 106 is related to the temperature of the first fluid in the hot water sub-system 104. For example, when the temperature of the first fluid in the cold water sub-system 106 decreases, the temperature of the first fluid in the hot water sub-system 104 increase because a typical refrigeration sub-system increases the load on the compressor to achieve the lower temperature in the cold water sub-system and has to reject the heat to the hot water sub-system. Without additional heat rejection and absorption capacity, the HVAC system 100 will not have enough operational degrees of freedom to achieve both the dry bulb set point and the dew point set point of the conditioning outlet air 114.

For example, if the temperature of the first fluid of the hot water sub-system 104 is such that the dew point of the conditioning outlet air 114 is at the set point but the dry bulb temperature of the conditioning outlet air 114 is above the set point, the system will reduce the temperature of the first fluid of the cold water sub-system 106 to reduce the dry bulb temperature of the conditioning outlet air 114 to the set point. However, reducing the temperature of the first fluid of the cold water sub-system 106 increases the temperature of the first fluid of the hot water sub-system 104 as described above. Without additional heat rejection capability, the HVAC system 100 will not be able to achieve both the dry bulb set point and the dew point set point of the conditioning outlet air 114.

The refrigerant sub-system 102 described herein includes the refrigerant-air heat exchanger 144 that operates as an additional condenser or evaporator to enable the HVAC system 100 to achieve both the dry bulb set point and the dew point set point of the conditioning outlet air 114. Specifically, in the first operating mode, the refrigerant-air heat exchanger 144 functions as a condenser for additional heat transfer from the refrigerant, and, in the second operating mode, the refrigerant-air heat exchanger 144 functions as an evaporator for additional heat transfer into the refrigerant. That is, the refrigerant-air heat exchanger 144 enables the HVAC system 100 to increase sensible cooling capability of the HVAC system 100 in the first operating mode and increase latent cooling capability of the HVAC system in the second operating mode. Additionally, inclusion of the dual mode refrigerant-air heat exchanger 144 in the refrigerant sub-system 102 reduces the complexity of the hot water sub-system 104 and the cold water sub-system 106 because the single refrigerant-air heat exchanger replaces multiple heat transfer operations that are typically included in the hot and cold water sub-systems. Moreover, because the latent and sensible cooling capabilities of the HVAC system 100 have been shifted from the hot and cold water sub-systems 104 and 106 to the refrigerant sub-system 102, the overall latent and sensible cooling requirements of the HVAC system have been decreased when compared to prior HVAC systems and the HVAC system is more efficient when compared to prior HVAC systems.

Additionally, some operating conditions may require a specific ratio of sensible to latent cooling. Specifically, if the HVAC system 100 is required to supply a specific ratio of sensible to latent cooling, the temperature of the first fluid of the hot and cold water sub-systems is tuned to achieve the specific ratio of sensible to latent cooling. For example, if less sensible cooling for a fixed amount of latent cooling is required, the refrigerant-air heat exchanger 144 is operated as an evaporator to raise the cold water temperature, which, in turn, lowers the available sensible cooling of the conditioning inlet air 112. If, however, more sensible cooling for a fixed amount of latent cooling is required, the refrigerant-air heat exchanger 144 is operated as an condenser, reducing the hot water temperature, which, in turn, lowers the amount of latent cooling of the conditioning inlet air 112.

In both the first and second operational modes, the compressor 134 receives an uncompressed, vapor refrigerant 146 and 148 at a first pressure and compresses the uncompressed, vapor refrigerant into a compressed, vapor refrigerant 150, 152 at a second pressure higher than the first pressure. The condenser 126 receives a first portion 150 of the compressed, vapor refrigerant 150, 152 and condenses the first portion of the compressed, vapor refrigerant into a first portion 154 of a compressed, liquid refrigerant 154 and 156. The first and second expansion valves 136 and 138 receive the compressed, liquid refrigerant 154 and 156 and expand the compressed, liquid refrigerant into an uncompressed, liquid refrigerant 158 and 160. The evaporator 124 receives the uncompressed, liquid refrigerant 158 and 160 and vaporizes the uncompressed, liquid refrigerant into the uncompressed, vapor refrigerant 146 and 148 at the first pressure. The first and second on/off valves 140 and 142 enable the refrigerant sub-system 102 to be reconfigured between the first and second operating modes.

FIG. 5 is a schematic flow diagram of the refrigerant sub-system 102 in the first operating mode. In the first operating mode, the refrigerant-air heat exchanger 144 functions as a condenser for additional heat transfer from the refrigerant to increase the sensible cooling capacity for a fixed amount of latent cooling capacity of the HVAC system 100. The first on/off valve 140 is open and the second on/off valve 142 is closed, permitting a second portion 152 of the compressed, vapor refrigerant 150, 152 to flow to the refrigerant-air heat exchanger 144. The refrigerant-air heat exchanger 144 condenses the second portion 152 of the compressed, vapor refrigerant 150, 152 into a second portion 156 of a compressed, liquid refrigerant 154 and 156. Specifically, the refrigerant-air heat exchanger 144 transfers heat from the second portion 152 of the compressed, vapor refrigerant 150, 152 to a flow of air 162, condensing the second portion of the compressed, vapor refrigerant into the second portion 156 of a compressed, liquid refrigerant 154 and 156. The refrigerant-air heat exchanger 144 acts as a second condenser within the refrigerant sub-system 102 in the first operating mode, increasing the sensible cooling capacity for a fixed amount of latent cooling capacity of the HVAC system 100.

In the first operating mode, the condenser 126 also receives and condenses the first portion 150 of the compressed, vapor refrigerant 150, 152 as described above. The second portion 156 of the compressed, liquid refrigerant 154 and 156 flows from the refrigerant-air heat exchanger 144 to mix with the first portion 154 of the compressed, liquid refrigerant 154 and 156. The second portion 156 of the compressed, liquid refrigerant 154 and 156 bypasses the second expansion valve 138 in the first operating mode. Specifically, the refrigerant sub-system 102 also includes a check valve 155 that bypasses the second expansion valve 138 and channels the compressed, liquid refrigerant 156 around the second expansion valve. The first expansion valve receives the mixed compressed, liquid refrigerant 154 and 156 and expands the compressed, liquid refrigerant into a first portion 158 of the uncompressed, liquid refrigerant 158 and 160. The first portion 158 of the uncompressed, liquid refrigerant 158 and 160 flows to the evaporator 124, and the evaporator vaporizes the uncompressed, liquid refrigerant into a first portion 146 of the uncompressed, vapor refrigerant 146 and 148 at the first pressure. The compressor 134 receives the first portion 146 of the uncompressed, vapor refrigerant 146 and 148 at the first pressure and compresses the uncompressed, vapor refrigerant into the compressed, vapor refrigerant 150, 152 at the second pressure higher than the first pressure.

FIG. 6 is a schematic flow diagram of the refrigerant sub-system 102 in the second operating mode. In the second operating mode, the refrigerant-air heat exchanger 144 functions as an evaporator for additional heat transfer into the refrigerant to decrease the sensible cooling capacity for a fixed amount of latent cooling capacity of the HVAC system 100. The first on/off valve 140 is closed and the second on/off valve 142 is open, preventing the second portion 152 of the compressed, vapor refrigerant 150, 152 from flowing to the refrigerant-air heat exchanger 144. Rather, all of the refrigerant compressed by the compressor 134 flows to the condenser 126 as the first portion 150 of the compressed, vapor refrigerant 150, 152. The condenser 126 condenses the first portion 150 of the compressed, vapor refrigerant 150, 152 into first portion 154 of the compressed, liquid refrigerant 154 and 156. The first portion 150 of the compressed, vapor refrigerant 150, 152 is split such that the first expansion valve 136 expands the first portion of the compressed, liquid refrigerant into the first portion 158 of the uncompressed, liquid refrigerant 158 and 160, and the second expansion valve 138 expands the first portion of the compressed, liquid refrigerant into a second portion 160 of the uncompressed, liquid refrigerant 158 and 160. The first expansion valve 136 controls the flow of the first portion 158 of the uncompressed, liquid refrigerant 158 and 160 to the evaporator 124, and the second expansion valve 138 controls the flow of the second portion 160 of the uncompressed, liquid refrigerant 158 and 160 to the refrigerant-air heat exchanger 144.

The refrigerant-air heat exchanger 144 receives the second portion 160 of the uncompressed, liquid refrigerant 158 and 160 and transfers heat from the air 162 to the second portion of the uncompressed, liquid refrigerant, vaporizing the second portion of the uncompressed, liquid refrigerant into a second portion 148 of the uncompressed, vapor refrigerant 146 and 148. The refrigerant-air heat exchanger 144 acts as a second evaporator within the refrigerant sub-system 102 in the second operating mode, decreasing the sensible cooling capacity for a fixed amount of latent cooling capacity of the HVAC system 100. Additionally, the evaporator 124 receives the first portion 158 of the uncompressed, liquid refrigerant 158 and 160 and transfers heat from the air to the first portion of the uncompressed, liquid refrigerant, vaporizing the second portion of the uncompressed, liquid refrigerant into the first portion 146 of the uncompressed, vapor refrigerant 146 and 148. The first and second portions 146 and 148 of the uncompressed, vapor refrigerant 146 and 148 are mixed and flow to the compressor 134.

The first operating mode enables the refrigerant sub-system 102 to reject heat to the atmosphere when the refrigerant absorbs more heat from the cold water sub-system 106 than can be rejected to the regeneration inlet air 116 without deviating from the dew point set point of the conditioning outlet air 114. Specifically, if too much heat is transferred from the conditioning inlet air 112 to the cold water sub-system 106 such that the heat cannot be rejected to the regeneration inlet air 116 without deviating from the dew point set point of the conditioning outlet air 114, the refrigerant-air heat exchanger 144 acts as an additional condenser to reject the excess heat to the atmosphere. Conversely, the second operating mode enables the refrigerant sub-system 102 to absorb heat from the atmosphere when the temperature of the first fluid of the cold water sub-system 104 is too cold and the temperature of the conditioning outlet air 114 deviates from the dry bulb set point of the conditioning outlet air 114. Specifically, if the dew point of the conditioning outlet air 114 is at the set point and the temperature of the first fluid of the cold water sub-system 104 is too cold such that the temperature of the conditioning outlet air 114 is below the dry bulb set point, the refrigerant-air heat exchanger 144 acts as an additional evaporator to absorb the additional heat from the atmosphere and increase the temperature of the first fluid and the conditioning outlet air 114 without changing the dew point of the conditioning outlet air. Thus, the operational modes of the refrigerant-air heat exchanger 144 enable the HVAC system 100 to condition the conditioning outlet air 114 to the dry bulb and dew point set points simultaneously. That is, the operational modes of the refrigerant-air heat exchanger 144 provides an additional degree of freedom to allow the system to achieve both the dry bulb and dew point set points simultaneously in a single piece of heat transfer equipment.

In the third operating mode, the refrigerant-air heat exchanger 144 is bypassed and the refrigerant sub-system 102 operates like a typical refrigerant sub-system. If the dry bulb and dew point set points are achieved without the need for excess heat rejection or additional heat absorption, the refrigerant-air heat exchanger 144 is bypassed and the refrigerant sub-system 102 operates like a typical refrigerant sub-system.

Figure 7:
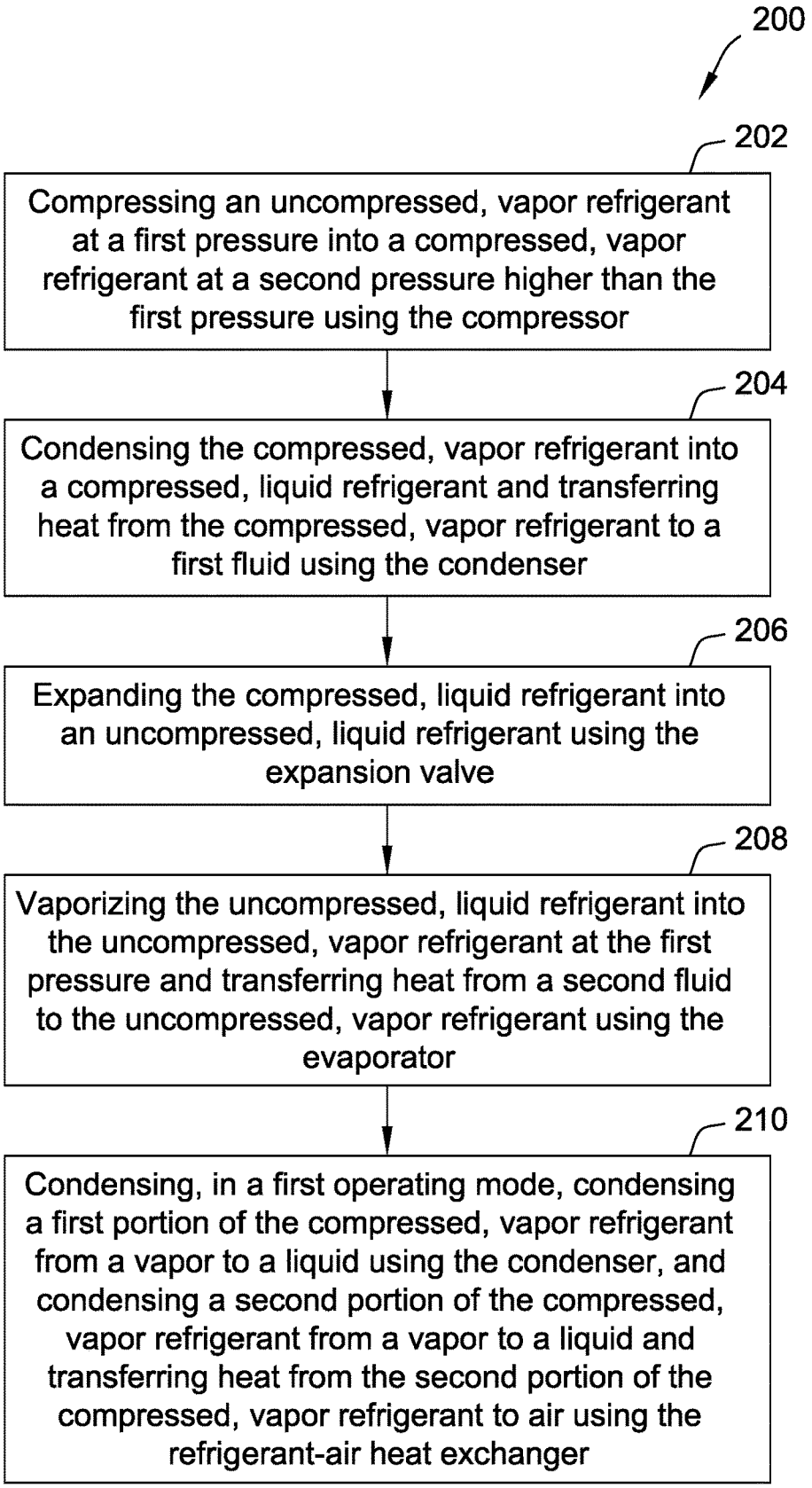
FIG. 7 is a flow diagram of a method of transferring heat from the cold water sub-system illustrated in FIG. 3 to the hot water sub-system illustrated in FIG. 2 using the refrigerant sub-system illustrated in FIGS. 4-6.

FIG. 7 is a flow diagram of a method 200 of transferring heat from a cold water sub-system of a heating, ventilation, and air conditioning (HVAC) system to a hot water sub-system of the HVAC system using a refrigerant sub-system. The refrigerant sub-system includes a compressor, a condenser, an evaporator, an expansion valve, and a refrigerant-air heat exchanger. The method 200 includes compressing 202 an uncompressed, vapor refrigerant at a first pressure into a compressed, vapor refrigerant at a second pressure higher than the first pressure using the compressor. The method 200 also includes condensing 204 the compressed, vapor refrigerant into a compressed, liquid refrigerant and transferring heat from the compressed, vapor refrigerant to a first fluid using the condenser. The method 200 further includes expanding 206 the compressed, liquid refrigerant into an uncompressed, liquid refrigerant using the expansion valve. The method 200 also includes vaporizing 208 the uncompressed, liquid refrigerant into the uncompressed, vapor refrigerant at the first pressure and transferring heat from a second fluid to the uncompressed, vapor refrigerant using the evaporator. The method 200 further includes condensing 210, in a first operating mode, a first portion of the compressed, vapor refrigerant from a vapor to a liquid using the condenser, and condensing a second portion of the compressed, vapor refrigerant from a vapor to a liquid and transferring heat from the second portion of the compressed, vapor refrigerant to air using the refrigerant-air heat exchanger.

Example HVAC systems described include multiple sub-systems for removing heat and moisture from a flow of air. The HVAC systems include a refrigerant sub-system, a hot water sub-system, and a cold water sub-system, which improve the efficiency of the HVAC systems. The hot and cold water sub-systems are closed systems that do not include additional heat transfer capability. Rather, the refrigerant sub-system described includes a refrigerant-air heat exchanger with multiple operating modes that transfer heat to the environment or absorbs heat from the environment depending on the operational needs of the HVAC system. The multiple operating modes of the refrigerant-air heat exchanger increases the operational flexibility of the refrigerant sub-system and the HVAC system while decreasing the operational complexity of the hot and cold water sub-systems. Additionally, because the refrigerant-air heat exchanger replaces multiple pieces of heat transfer equipment within the hot and cold water sub-systems, the capital cost to the HVAC system described herein in reduced when compared to prior HVAC systems. Moreover, because some of the heat transfer capabilities of the HVAC system have been shifted from the hot and cold water sub-systems to a single piece of equipment in the refrigerant sub-system, the overall heat transfer requirements of the HVAC system have been decreased when compared to prior HVAC systems and the HVAC system is more efficient when compared to prior HVAC systems. Accordingly, the HVAC systems described herein are less complex, have a lower capital cost, and are more efficient than prior HVAC systems.

Example embodiments of HVAC systems and methods of operating the systems are described above in detail. The systems and methods are not limited to the specific embodiments described herein, but rather, components of the system and methods may be used independently and separately from other components described herein. For example, the systems described herein may be used in systems other than HVAC systems.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A heating, ventilation, and air conditioning (HVAC) system, the HVAC system comprising:

a hot water sub-system for circulating a flow of a first fluid between a first heat exchanger and a condenser, wherein the first heat exchanger is adapted to transfer moisture and heat between a liquid desiccant and air, and to transfer heat from the first fluid to the liquid desiccant and the air;

a cold water sub-system for circulating a flow of a second fluid between a second heat exchanger and an evaporator, wherein the second heat exchanger is adapted to transfer moisture and heat between the liquid desiccant and the air, and to transfer heat from the liquid desiccant and the air to the second fluid; and a refrigerant sub-system for transferring heat from the cold water sub-system to the hot water sub-system, the refrigerant sub-system comprising:

a compressor for compressing uncompressed, vapor refrigerant at a first pressure into a compressed, vapor refrigerant at a second pressure higher than the first pressure;

the condenser for condensing the compressed, vapor refrigerant into a compressed, liquid refrigerant, and for transferring heat from the compressed, vapor refrigerant to the first fluid;

an expansion valve for expanding the compressed, liquid refrigerant into an uncompressed, liquid refrigerant;

the evaporator for vaporizing the uncompressed, liquid refrigerant into the uncompressed, vapor refrigerant at the first pressure, and for transferring heat from the second fluid to the uncompressed, vapor refrigerant; and a refrigerant-air heat exchanger having a first operating mode and a second operating mode, wherein:

in the first operating mode, the condenser is adapted to condense a first portion of the compressed, vapor refrigerant from a vapor to a liquid, and the refrigerant-air heat exchanger is adapted to condense a second portion of the compressed, vapor refrigerant from a vapor to a liquid and transfer heat from the second portion of the compressed, vapor refrigerant to the air; and in the second operating mode, the evaporator is adapted to vaporize a first portion of the uncompressed, liquid refrigerant from a liquid to a vapor, and the refrigerant-air heat exchanger is adapted to vaporize a second portion of the uncompressed, liquid refrigerant from a liquid to a vapor and transfer heat from the air to the second portion of the uncompressed, liquid refrigerant.

2. The HVAC system of claim 1, wherein the hot water sub-system includes the condenser, a first pump, and the first heat exchanger, wherein the first pump is adapted to receive the flow of the first fluid from the first heat exchanger and pump the flow of the first fluid to the condenser.

3. The HVAC system of claim 1, wherein the cold water sub-system includes the evaporator, a second pump, and the second heat exchanger, wherein the second pump is adapted to receive the flow of the second fluid from the second heat exchanger and pump the flow of the second fluid to the evaporator.

4. The HVAC system of claim 1, wherein the first and second fluids are water.

5. The HVAC system of claim 1, wherein the expansion valve is a first expansion valve, wherein the refrigerant sub-system comprises a second expansion valve, and wherein, in the first operating mode, the first expansion valve is adapted to expand the compressed, liquid refrigerant into the uncompressed, liquid refrigerant.

6. The HVAC system of claim 5, further comprising a check valve disposed for bypassing the second expansion valve, and wherein, in the first operating mode, the check valve is adapted to channel a first portion of the compressed, liquid refrigerant around the second expansion valve.

7. The HVAC system of claim 5, wherein, in the second operating mode, the first expansion valve is adapted to control the first portion of the uncompressed, liquid refrigerant to the evaporator and the second expansion valve is adapted to control the second portion of the uncompressed, liquid refrigerant to the refrigerant-air heat exchanger.

8. The HVAC system of claim 5, further comprising a first on/off valve and a second on/off valve, and wherein, in the first operating mode, the first on/off valve is open to channel the second portion of the compressed, vapor refrigerant from the compressor to the refrigerant-air heat exchanger, and the second on/off valve is closed.

9. The HVAC system of claim 8, wherein, in the second operating mode, the second on/off valve is open to channel a second portion of the uncompressed, vapor refrigerant from the refrigerant-air heat exchanger to the compressor, and the first on/off valve is closed.

10. The HVAC system of claim 8, wherein the first and second on/off valves are solenoid valves.

11. The HVAC system of claim 1, wherein the expansion valve is a thermal expansion valve.

12. The HVAC system of claim 1, wherein the refrigerant-air heat exchanger is a refrigerant-air coil.

13. A heating, ventilation, and air conditioning (HVAC) system, the HVAC system comprising:

a first fluid sub-system comprising a first heat exchanger, a condenser, and a pump for circulating a first fluid between the first heat exchanger and the condenser;

a second fluid sub-system comprising a second heat exchanger, an evaporator, and a pump for circulating a second fluid between the second heat exchanger and the evaporator;

a liquid desiccant circuit for circulating a liquid desiccant between the first heat exchanger and the second heat exchanger; and a refrigerant sub-system for transferring heat from the second fluid circulating in the second fluid sub-system to the first fluid circulating in the first fluid sub-system, the refrigerant sub-system comprising:

a compressor for compressing uncompressed, vapor refrigerant at a first pressure into a compressed, vapor refrigerant at a second pressure higher than the first pressure;

the condenser for condensing the compressed, vapor refrigerant into a compressed, liquid refrigerant, and for transferring heat from the compressed, vapor refrigerant to the first fluid;

an expansion valve for expanding the compressed, liquid refrigerant into an uncompressed, liquid refrigerant;

the evaporator for vaporizing the uncompressed, liquid refrigerant into the uncompressed, vapor refrigerant at the first pressure, and for transferring heat from the second fluid to the uncompressed, vapor refrigerant; and a refrigerant-air heat exchanger having a first operating mode and a second operating mode, wherein, in the first operating mode, the condenser is adapted to condense a first portion of the compressed, vapor refrigerant from a vapor to a liquid, and the refrigerant-air heat exchanger is adapted to condense a second portion of the compressed, vapor refrigerant from a vapor to a liquid and transfer heat from the second portion of the compressed, vapor refrigerant to the air.

14. The HVAC system of claim 13, wherein the first heat exchanger is adapted to transfer moisture and heat between the liquid desiccant and air and transfer heat from the first fluid to the liquid desiccant and the air, and wherein the second heat exchanger is adapted to transfer moisture and heat between the liquid desiccant and the air and to transfer heat from the liquid desiccant and the air to the second fluid.

15. The HVAC system of claim 13, wherein, in the second operating mode, the evaporator is adapted to vaporize a first portion of the uncompressed, liquid refrigerant from a liquid to a vapor, and the refrigerant-air heat exchanger is adapted to vaporize a second portion of the uncompressed, liquid refrigerant from a liquid to a vapor and transfer heat from the air to the second portion of the uncompressed, liquid refrigerant.

16. The HVAC system of claim 13, wherein the first and second fluids are water.

17. A heating, ventilation, and air conditioning (HVAC) system, the HVAC system comprising:

a first fluid sub-system comprising a first heat exchanger, a condenser, and a pump for circulating a first fluid between the first heat exchanger and the condenser;

a second fluid sub-system comprising a second heat exchanger, an evaporator, and a pump for circulating a second fluid between the second heat exchanger and the evaporator;

a liquid desiccant circuit for circulating a liquid desiccant between the first heat exchanger and the second heat exchanger; and a refrigerant sub-system for transferring heat from the second fluid circulating in the second fluid sub-system to the first fluid circulating in the first fluid sub-system, the refrigerant sub-system comprising:

a compressor for compressing uncompressed, vapor refrigerant at a first pressure into a compressed, vapor refrigerant at a second pressure higher than the first pressure;

the condenser for condensing the compressed, vapor refrigerant into a compressed, liquid refrigerant, and for transferring heat from the compressed, vapor refrigerant to the first fluid;

an expansion valve for expanding the compressed, liquid refrigerant into an uncompressed, liquid refrigerant;

the evaporator for vaporizing the uncompressed, liquid refrigerant into the uncompressed, vapor refrigerant at the first pressure, and for transferring heat from the second fluid to the uncompressed, vapor refrigerant; and a refrigerant-air heat exchanger having a first operating mode and a second operating mode, wherein, in the second operating mode, the evaporator is adapted to vaporize a first portion of the uncompressed, liquid refrigerant from a liquid to a vapor, and the refrigerant-air heat exchanger is adapted to vaporize a second portion of the uncompressed, liquid refrigerant from a liquid to a vapor and transfer heat from the air to the second portion of the uncompressed, liquid refrigerant.

18. The HVAC system of claim 17, wherein the first heat exchanger is adapted to transfer moisture and heat between the liquid desiccant and air and transfer heat from the first fluid to the liquid desiccant and the air, and wherein the second heat exchanger is adapted to transfer moisture and heat between the third fluid liquid desiccant and the air and to transfer heat from the liquid desiccant and the air to the second fluid.

19. The HVAC system of claim 17, wherein, in the first operating mode, the condenser is adapted to condense a first portion of the compressed, vapor refrigerant from a vapor to a liquid, and the refrigerant-air heat exchanger is adapted to condense a second portion of the compressed, vapor refrigerant from a vapor to a liquid and transfer heat from the second portion of the compressed, vapor refrigerant to the air.

20. The HVAC system of claim 17, wherein the first and second fluids are water.

* * * * *